US008894342B1

(12) United States Patent
Masciana et al.

(10) Patent No.: US 8,894,342 B1
(45) Date of Patent: Nov. 25, 2014

(54) AUTOMATICALLY RETRACTABLE BOARDING RAMP ASSEMBLY FOR A MARINE VESSEL

(71) Applicants: Raymond Masciana, Cape Coral, FL (US); Genaro Esposito, Deer Park, NY (US)

(72) Inventors: Raymond Masciana, Cape Coral, FL (US); Genaro Esposito, Deer Park, NY (US)

( * ) Notice: Subject to any disclaimer, the term of this patent is extended or adjusted under 35 U.S.C. 154(b) by 96 days.

(21) Appl. No.: 13/690,458

(22) Filed: Nov. 30, 2012

Related U.S. Application Data

(60) Provisional application No. 61/629,887, filed on Nov. 30, 2011.

(51) Int. Cl.
*B63B 27/14* (2006.01)
*B63C 3/06* (2006.01)

(52) U.S. Cl.
CPC ..... *B63B 27/143* (2013.01); *B63C 3/06* (2013.01)
USPC ..... 414/139.5; 114/362

(58) Field of Classification Search
USPC ..... 414/139.5, 139.6, 140.1; 14/69.5, 71.1, 14/71.3; 405/1, 3, 4; 114/362, 258, 263, 114/48, 344, 366; 187/337, 338
See application file for complete search history.

(56) References Cited

U.S. PATENT DOCUMENTS

| | | | | | |
|---|---|---|---|---|---|
| 3,228,051 | A * | 1/1966 | Voase et al. | ..... | 14/71.1 |
| 3,426,719 | A * | 2/1969 | Mizell | ..... | 14/71.7 |
| 4,003,473 | A * | 1/1977 | Ryan | ..... | 14/71.7 |
| 4,083,072 | A * | 4/1978 | Ryan | ..... | 14/69.5 |
| 4,133,067 | A * | 1/1979 | Bennett et al. | ..... | 14/71.3 |
| 2013/0283550 | A1 * | 10/2013 | Clarke | ..... | 14/69.5 |

FOREIGN PATENT DOCUMENTS

WO WO 8705875 A1 * 10/1987

* cited by examiner

*Primary Examiner* — Sunil Singh
(74) *Attorney, Agent, or Firm* — William E. Noonan

(57) ABSTRACT

A retractable boarding assembly for use with a marine vessel mounted on a boat lift includes an elongate ramp pivotally mounted to a dock or other structure adjacent to the boat lift and supported boat. There is a directional pulley supported above a body of water adjacent to the dock. An elongate cable or marine rope engages the pulley. A first end of the cable is secured to a lift platform of the boat lift. An opposite, second end of the cable is secured to the ramp. Raising the boat lift with a boat supported thereon allows the ramp to pull the attached cable across the pulley until the boarding ramp is pivotally deployed to engage a deck of the supported boat. Alternatively, when the boat lift is lowered to introduce the boat into the water, the lift platform pulls the cable through the directional pulley such that the boarding ramp is pivotally retracted and disengaged from the deck of the boat.

14 Claims, 3 Drawing Sheets

AUTOMATICALLY RETRACTABLE BOARDING RAMP ASSEMBLY FOR A MARINE VESSEL

RELATED APPLICATION

This application claims the benefit of U.S. Provisional Patent Application Ser. No. 61/629,887, filed Nov. 30, 2011.

FIELD OF THE INVENTION

This invention relates to a retractable boarding ramp assembly for boats and other types of marine vessels. The boarding ramp is automatically deployed and retracted by respectively raising and lowering a boat lift on which the marine vessel is supported.

BACKGROUND OF THE INVENTION

Boarding ramps are commonly used to assist persons getting into and departing from a boat or other type of marine vessel. Many, if not most boarding ramps, are portable. At the commencement of a boat trip, the ramp must be securely installed between the dock or pier and the vessel. After all passengers have boarded the boat, the ramp must then be physically removed. This procedure is then repeated at the termination of the trip so that the passengers may safely and comfortably disembark the boat. The current technique of repeatedly deploying and removing the boat ramp tends to be unsafe, extremely time consuming, laborious and tedious. Typically, at least one crewman of passenger must jump back and forth between the vessel and adjacent dock, both at the beginning and at the end of the trip. To date, most boat ramps have required this type of inconvenient manual installation and removal.

SUMMARY OF THE INVENTION

It is therefore an object of the present invention to provide a retractable boat ramp assembly that is automatically deployed and retracted as needed to permit boaters to quickly, conveniently and safely board and disembark from a marine vessel.

It is a further object of this invention to provide a retractable boarding ramp assembly that is particularly effective and safe for use with marine vessels supported on a boat lift.

It is a further object of this invention to provide a boat ramp boarding assembly that is automatically driven by operation of a boat lift such that the ramp is safely deployed when the boat lift is raised and retracted when the boat lift is lowered.

It is a further object of this invention to provide an automatic boat ramp apparatus that improves the safety and greatly reduces the time, tedium, physical effort, risk of injury and aggravation associated with installing and removing a boarding ramp both before and after a boat trip.

This invention results from a realization that a boarding ramp for a marine vessel supported on a boat lift may be quickly, securely and effectively deployed and retracted in an advantageous, automatic manner by operatively interconnecting the boarding ramp to the lift platform of the boat lift. The boarding ramp and the boat lift are operatively interconnected by a pulley and cable assembly such that when the boat lift raises the vessel, the boarding ramp is deployed between the vessel and an adjoining dock or pier. Alternatively, when the boat lift is lowered to introduce the vessel into the water, the boarding ramp is retracted from the vessel so that the vessel can depart on a trip safely without interference from the boarding ramp.

This invention features a safely and conveniently operated retractable boarding ramp assembly for a marine vessel supported on a boat lift. The assembly includes an elongate ramp having a proximal first end that is pivotally mounted to a fixed structure, such as a dock, pier or seawall, adjoining the vessel. An opposite second end of the ramp is engageable with the vessel when the ramp is deployed. A pulley support post is mounted to and extends upwardly from the dock, pier or seawall. The support post carries a directional pulley proximate the upper end of the post. An elongate cable is operably engaged with the pulley. A first end of the cable is secured to a lift platform of the boat lift. An opposite, second end of the cable is connected to the ramp proximate the second end of the ramp. When the boat lift is operated to raise the platform and the vessel supported thereon, the cable is driven in a first direction about the directional pulley to pivotally lower the ramp such that the distal end of the ramp engages the vessel. Alternatively, when the boat lift is operated to lower the lift platform and the supported vessel into the water, the cable is driven in an opposite direction to pivotally raise the ramp such that the ramp is retracted and disengaged from the vessel.

In a preferred embodiment, the proximal end of the ramp is pivotally mounted to a bearing secured to the dock, pier, or seawall. The first and second ends of the cable may be secured respectively to the ramp and lift platform by respective eye bolts, knots and/or other forms of connection. Typically, the first end of the cable is secured to the ramp at a point longitudinally along the ramp that is closer to the distal end than to the proximal end of the ramp.

BRIEF DESCRIPTION OF THE SEVERAL VIEWS OF THE DRAWINGS

Other objects, features and advantages will occur from the following description of a preferred embodiment and the accompanying drawings, in which.

DETAILED DESCRIPTION OF THE INVENTION

Figure 1:
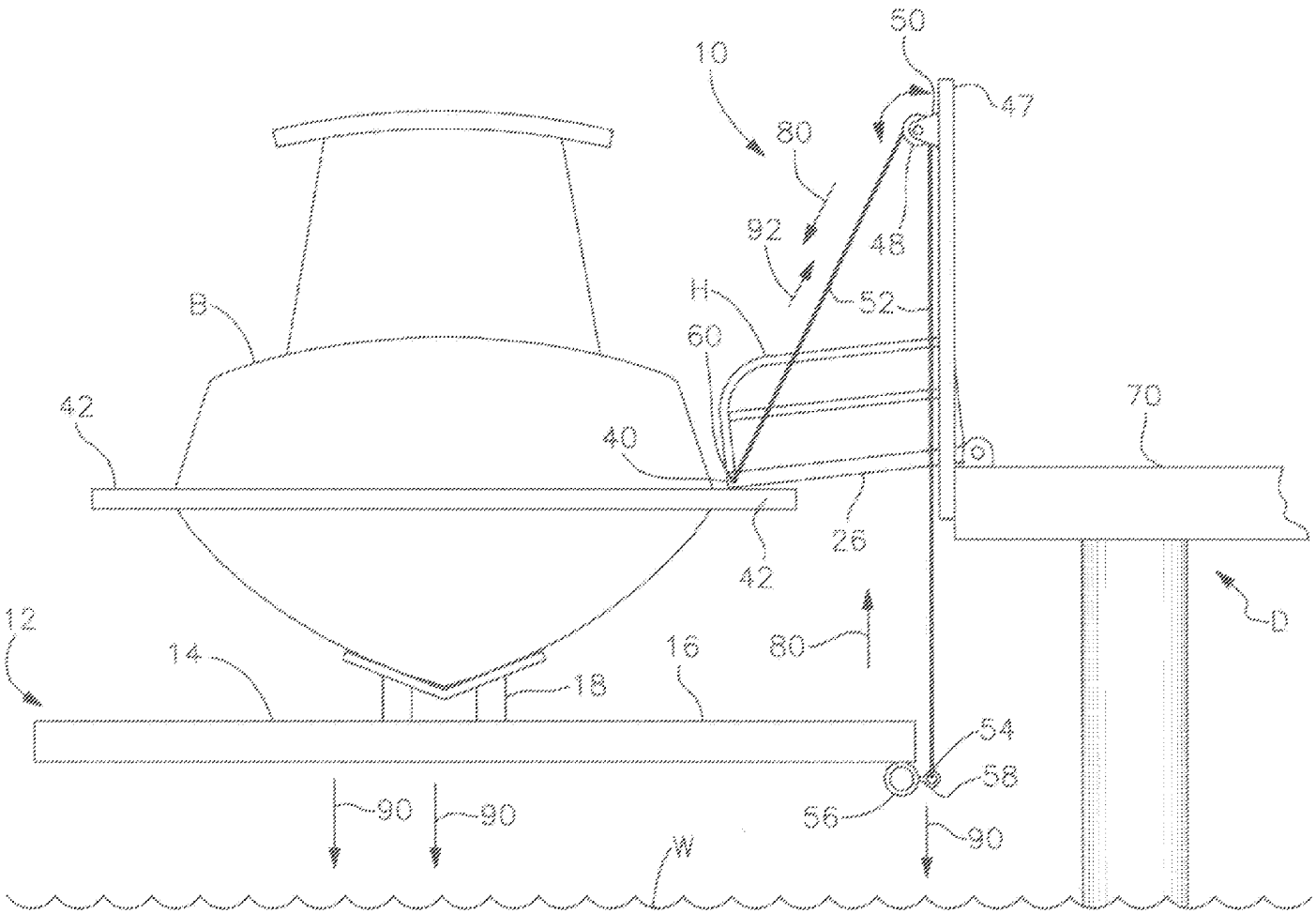
FIG. 1 is an elevational view of a preferred version of the automatically retractable boarding ramp assembly of this invention with an associated boat lift depicted in simplified form in a raised condition for deploying the ramp to engage the deck of a boat supported by the lift.
Figure 2:
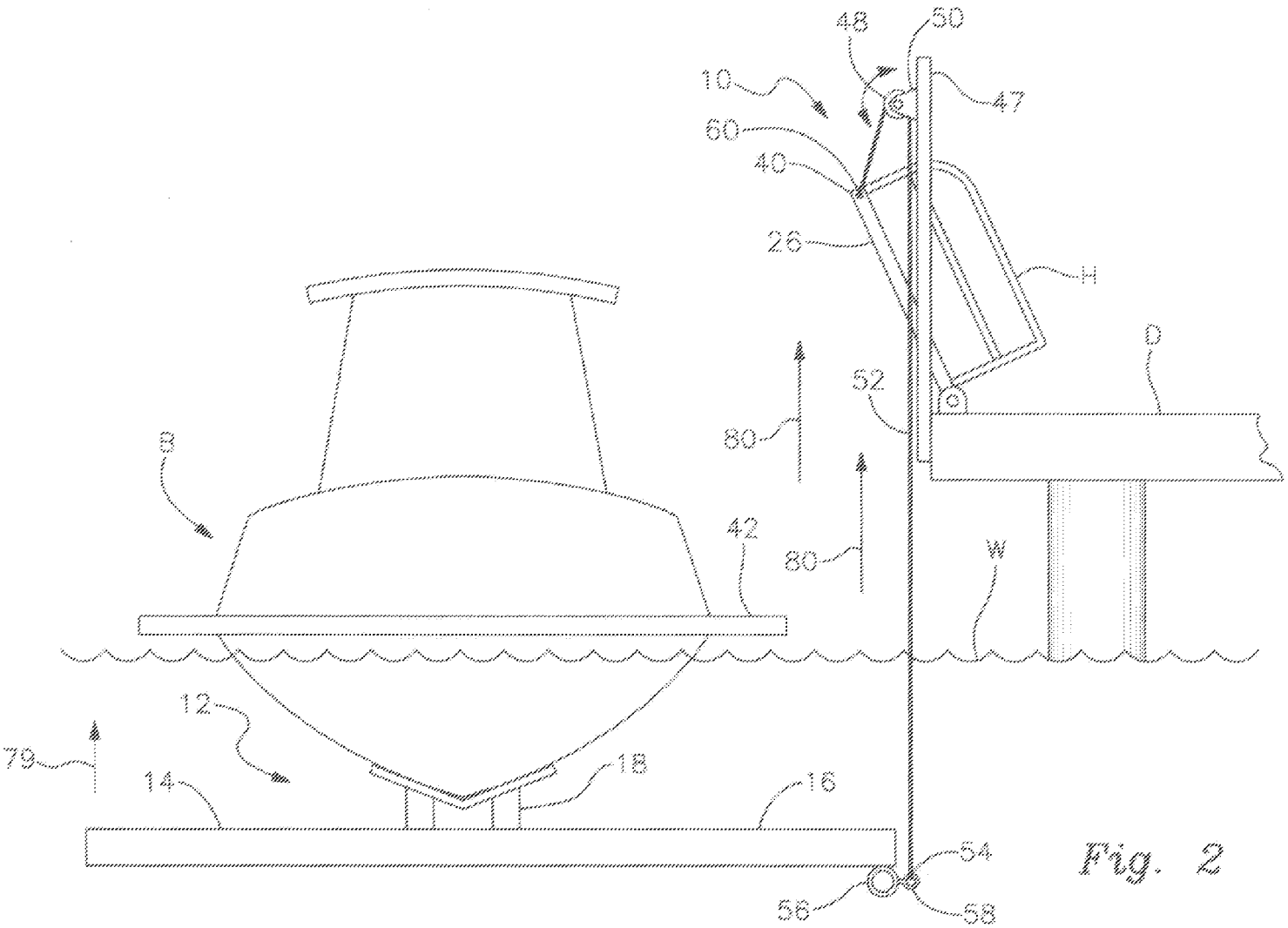
FIG. 2 is a view similar to FIG. 1 depicting the boat lift platform in a lowered condition such that the supported vessel is positioned in the water and the retractable boarding ramp is pivotally raised and disengaged from the boat.

There is shown in FIGS. 1 and 2 an automatically retractable boarding ramp assembly 10 that is operated by a conventional boat lift mechanism 12. The boat lift mechanism supports a boat B adjacent to a conventional dock structure D. As used herein "boat dock" should be understood to include all types of docks, piers, seawalls and other fixed structures proximate to which a boat is moored. "Boat" refers to all varieties and types of marine vessels. Neither the type of dock, not the type of boat constitutes a limitation of this invention. Boat lift mechanism 12 is depicted in a simplified and a generally conceptual manner in FIGS. 1 and 2. The drive motors, lift cables and various other standard components of the lift are omitted for clarity. As with most standard boat lifts, mechanism 12 includes a platform 14 comprising a plurality of transverse cradle beams 16. Supportive bunks 18 are typically mounted to the cradle beams proximate the fore and aft of the lift. In some lifts, a supportive bunk or bunk boards may extend for generally the entire length of the lift for engaging the keel and/or hull of boat B. Guides or centering poles (not shown) may be attached to and extend upwardly from the cradle beams 14 for centering the boat. Drive motors, likewise omitted, are typically mounted to dock D or adjoining piling S and operably connected to platform 14 by means of winches, cables and other conventional components, which are again not depicted. It should be understood that the retractable ramp of this invention may be employed with virtually all conventional and future boat lifts wherein a boat-supporting platform is selectively raised and lowered adjacent to a boat docking structure. The platform itself may have various alternative forms of construction. The particular components of the boat lift (e.g. motors, winches, cable, etc) as well as the assembly and operation of those components will be known to persons skilled in the art and by themselves do not define or limit this invention. The retractable boarding ramp assembly of this invention merely requires the use of a boat-supporting lift platform that is alternatively raised and lowered relative to an underlying body of water in a manner that will be understood to persons skilled in the art.

By the same token, the lift and boarding ramp assembly may be utilized adjacent to almost any type of docking structure including wood, synthetic and/or concrete docks, piers, seawalls, pilings, etc. For purposes of illustration herein, dock D is shown in the drawings, however, dock D should be understood to represent any and all types of generally fixed mooring or berthing structures located adjacent to a boat slip and supportive of a boat lift.

Figure 3:
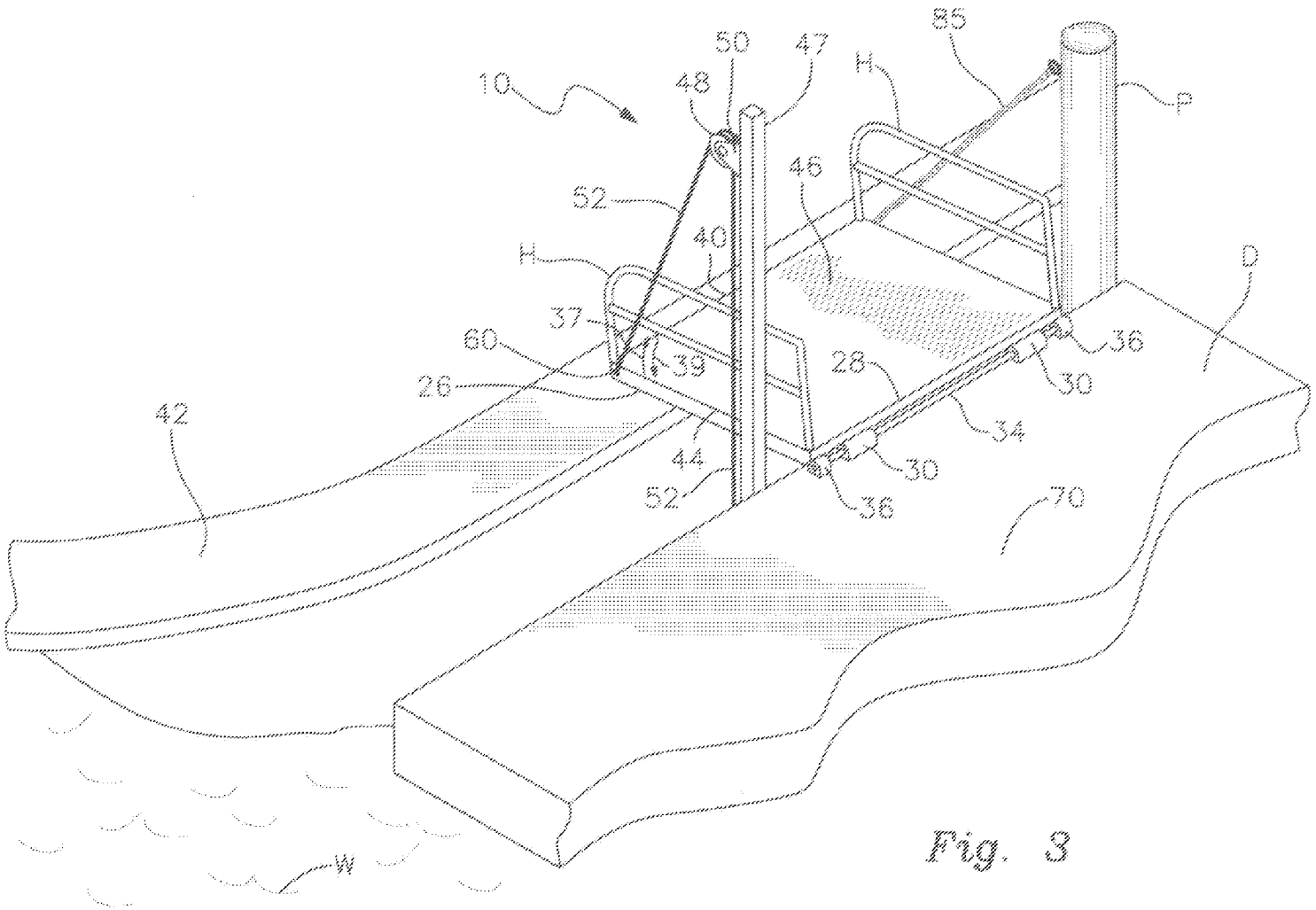
FIG. 3 is a perspective view of the boarding ramp assembly as seen from the dock on which the ramp is pivotally mounted.

Boarding ramp assembly 10 includes an elongate gangway, platform or ramp 26, also illustrated in FIG. 3, that is hingedly or pivotally mounted to dock D. More particularly, elongate ramp 26 includes a proximal end portion 28 that carries a pair of tubular bushings 30 that are welded or otherwise permanently secured to end 28 of ramp 26. A pair of spaced apart mounting blocks 36 are fastened by bolts or other means of attachment to the upper surface of dock D. An elongate pivot shaft 34 is held by mounting blocks 36. Bushings 30 receive and pivotally engage shaft 34 such that ramp 26 is pivotable upwardly and downwardly relative to dock D as indicated by arrows 37 and 39 in FIG 3. Alternative mechanisms and components may be used to pivotally mount ramp 26 to dock D.

Ramp 26 further includes a distal end portion 40 that is engageable with a deck 42 of boat B when the ramp is deployed as shown in FIG. 1. As best shown in FIG. 3, the ramp may have a metal base 44 that is covered by a non-slip carpet or covering 46, or alternatively, a marine grade planking. Various other materials may be used in the construction of the ramp. Typically, such materials should be structurally durable and supportive of one or more passengers. It is also important that the ramp include a non-slip surface. Various known ramp constructions may be employed within the scope of this invention. As shown in FIGS. 1-3, the ramp should also include handrails H that extends longitudinally along one side of the ramp for safety.

A pulley support post 47 is bolted or otherwise fixedly secured to a distal end of dock D. Post 47 may comprise an elongate tubular member having a circular or, as shown in FIG. 3, rectangular cross section and may be composed of aluminum, stainless steel or other structurally sturdy, corrosion resistant material. The pulley support post may have various heights in accordance with this invention. A directional pulley 48 is rotatably mounted to a mounting arm or bracket 50 extending horizontally from an upper portion of support 47. Mounting arm 50 may be bolted or otherwise securely fastened to the support post 47. Various other support means and configurations may be employed within the scope of this invention for operatively securing the rotatable directional pulley 48 to a support post or other structure such that the pulley is held outwardly of the dock D and above water W. The components of the pulley apparatus and mounting arm should be strong, durable and resistant to the corrosion that is otherwise apt to occur a marine environment.

Boarding ramp assembly 10 further includes a ramp actuating cable 52 that is engaged operatively with a grooved circumference of pulley 48. The cable may comprise steel strands that are assembled in a conventional manner to define a strong and durable cable. Various alternative materials such as a ⅜ inch marine rope may be used. A first end 54 of cable 52 is tied or otherwise secured to a longitudinal pipe 56 attached and extending transversely to cradle beams 16 of boat lift platform 14. More particularly, end 54 of cable 52 is secured to an eye hook 58 attached to pipe 56. In alternative embodiments, other means for attaching the lower end of the cable to the platform may be utilized. Indeed, the cable may be secured directly to a cradle beam or other fixed, permanent component of the boat lift platform 14.

An opposite upper end 60 of cable 52 is secured to distal end 40 of boarding ramp 26 in various ways. For example, the ramp actuating cable may be engaged with a fastening hole in one of the handrails H proximate the walking surface 70 of the platform. Cable 52 may be knotted or otherwise tied to the handrail H, which in the version shown herein is the handrail on the left hand side of ramp 26 in FIG. 3. In other versions, cable 52 may be secured to platform base 44 such as by tying the cable to an eyehook or other connective element carried by the base. Once again, various alternative means may be employed for attaching the upper end of the cable to the ramp. Cable 52 should be secured to ramp 26 at a point along the ramp that is closer to distal end 40 than to the proximal end 28 of the ramp. This enables the cable to reliably effectuate opening and closing of the pivotable ramp in response to operation of the boat lift as described more fully below.

In operation, lift platform 14 and boat B supported thereon are raised as needed, in the manner shown in FIG. 1, to position deck 42 of boat B adjacent to walking surface 70 of dock D. In this position, passengers and crew are allowed to board and/or disembark the boat as appropriate. Alternatively, the lift lowers platform 14 in support of boat B such that the boat is positioned in water W as shown in FIG. 2.

Boat ramp 26 is deployed when the boat is raised from the lowered position shown in FIG. 2 to the elevated position shown in FIG 1. As lift platform 14 is operated in a conventional manner and driven upwardly (see arrow 79 in FIG. 2) to raise boat B out of the water, the weight of platform 26 attached to end 60 of cable 52 causes the cable to be drawn through rotating directional pulley 48 in the manner depicted by arrows 80. Ramp 26 thus pivots downwardly about shaft 34 and drops from the position shown in FIG. 2 to that shown in FIG. 1. Boat B is concurrently elevated by lift 12 to assume the raised position shown in FIG. 1 wherein the boat is lifted out of the water. As illustrated in FIG. 1, distal end 40 of lowered ramp 26 drops until it engages the upper surface of elevated deck 42. This provides for a generally continuous, safe and convenient walking surface that allows passengers and crew to comfortably board the boat from walkway surface 70 of deck D or alternatively to securely disembark the boat by walking from deck 42 across ramp 26 to surface 70 of deck D.

As shown in FIG. 3, a chain 85 (or alternatively a rope or cable) is interconnected between a fixed piling P (which should be considered part of the dock structure) and distal end portion 40 of ramp 26 to provide improved control over lower of the ramp. In the depicted version the chain is secured at end to an eye hook attached to the pier P and at the opposite end to a lower end of the second hand rail (to which the ramp actuating cable is not directly secured). The distal end of ramp 26 is thereby held at two spaced apart points so that the ramp is lowered in a balanced and controlled manner. As a result, the ramp is less likely to drop suddenly and/or unevenly when it is deployed. The risk of possible damage to the boat is thereby reduced.

The ramp assembly is automatically retracted from the deck of boat B by reversing the foregoing operation. In particular, after the passengers and crew have boarded boat B from dock D via ramp 26, lift platform 14 is lowered from the position shown in FIG. 1 to that shown in FIG. 2 so that the boat is placed in water W. As lift port platform 14 is lowered in the direction of arrows 90, FIG. 1, pipe 56 of lift platform 14 likewise pulls end 54 of cable 52 downwardly in the direction of arrow 90. This draws cable 52 through directional pulley 48 such that end 60 of cable 52 is pulled upwardly in the direction of arrow 92. The cable in turn pulls ramp 26 upwardly such that the ramp pivots about pivot bearings 36. Distal end 40 of ramp 26 thereby disengages the deck of the boat descending on platform 14. The ramp swings upwardly from the position shown in FIG. 1 to that shown in FIG. 2. As a result, ramp 26 is disengaged from deck 42 of boat B. The boat may then be safely and conveniently launched without interference from the ramp. By the same token, when the boat has completed its trip and returns to its boat slip, the boat may be positioned onto the lift without interference from the raised ramp. As previously described, when the lift and boat are subsequently raised, the ramp again pivots downwardly from the position shown in FIG. 2 to that shown in FIG. 1 such that the distal end 40 of ramp 26 engages deck 42 of elevated boat B. Once again, a secure ramp or gangway is automatically deployed to allow persons to disembark from the vessel in a quick, convenient, stable and safe manner. Claim 85 again enables ramp 26 to be lowered and engages with deck 42 in a balanced and controlled manner.

In alternative embodiments, various alternative components may be employed to operatively interconnect the lift platform and the retractable boarding ramp. For example, a chain and complementary gear may be used in place of the ramp actuating cable and pulley. Various alternative types of hinges and pivots may be employed for mounting the ramp to the deck, pier or seawall. Each of the parts used in the assembly should comprise high grade, durable metal or plastic components that are suited for use on boat lifts and similar marine environments.

From the foregoing it may be seen that the apparatus of this invention provides for a retractable boarding ramp assembly for boats and other types of marine vessels and specifically designed to be used in conjunction with and operably driven by a boat lift. The assembly eliminates the traditional need to manually deploy a ramp between the boat and dock each time the vessel is boarded or unboarded. Considerable time and effort are therefore saved.

While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An automatically retractable boat ramp assembly for use in combination with a boat lift and an adjacent boat dock structure, which boat lift includes a lift platform for supporting a boat thereon adjacent to the boat dock structure and a drive mechanism for selectively raising the lift platform to lift the boat out of a body of water and lowering the lift platform to introduce the boat into the body of water, said boat ramp assembly comprising:

a ramp having a first end for pivotally attaching to the dock structure and an opposite second end for engaging the boat supported by the boat lift when the lift platform is raised and the boat is lifted out of the body of water;

a support post attached to and extending upwardly from the dock structure;

a pulley rotatably attached to said support post; and an elongate ramp actuating cable for interconnecting said ramp and the lift platform; said ramp actuating cable being operatively engaged with said pulley, whereby raising the lift platform with a boat supported thereon drives said ramp actuating cable in a first direction about said pulley to pivotally lower said ramp until said second end of said ramp engages the boat and lowering the lift platform with a boat supported thereon drives said ramp actuating cable in an opposite second direction about said pulley to pivotally raise said ramp and disengage said ramp from the boat.

2. The assembly of claim 1 in which said ramp includes a base for walking thereon and a first handrail carried by said base and extending upwardly from said base along a respective first longitudinal side edge of said ramp.

3. The assembly of claim 2 in which said cable is attached to said first handrail proximate said second end of said ramp.

4. The assembly of claim 3 further including a second handrail carried by said base and extending upwardly from said base along a second longitudinal side edge of said base and further including a flexible connection member for interconnecting said second handrail proximate said second end of said ramp to a nearby piling and controlling downward pivoting of said ramp relative to the docking structure and the boat.

5. The assembly of claim 1 in which said cable is attachable proximate a first end thereof to the lift platform, said cable being attached proximate and opposite, second end thereof to said ramp proximate said second end of said ramp.

6. The assembly of claim 1 in which said cable attaches to said ramp of a location along said ramp that is closer to said second end than said first end of said ramp.

7. The assembly of claim 1 further including a pivot shaft for mounting on the dock structure and at least one cylindrical housing carried by said first end of said ramp for pivotally engaging said pivot shaft and allowing said ramp to pivot upwardly and downwardly relative to said dock structure.

8. A combined boat lift and automatically retractable boat ramp assembly for use in conjunction with a boat dock structure, said assembly comprising:

a lift platform for supporting a boat thereon adjacent to the boat dock structure, said lift platform being selectively raised to lift the supported boat out of a body of water and lowered to introduce the supported boat into the body of water;

an elongate ramp having a first, proximal end for pivotally attaching to the dock structure and a second, distal end for engaging the boat supported by the boat lift when said lift platform is raised and the boat is lifted out of the body of water;

a support post mounted to the dock structure and supporting a rotatable pulley outwardly of the dock structure and above the body of water; and an elongate ramp actuating cable for interconnecting said ramp and said lift platform, said cable being operatively engaged with said pulley whereby raising said lift platform drives said cable in a first direction about said pulley to pivotally lower said ramp until said distal end of said ramp engages the boat and lowering said lift platform into the body of water drives said cable in an opposite second direction about said pulley to pivotally raise said ramp and disengage said ramp from the boat.

9. The assembly of claim 8 in which said ramp includes a base for walking thereon and a handrail carried by said base and extending upwardly from said base along a respective longitudinal side edge of said ramp.

10. The assembly of claim 9 in which said cable is attached to said handrail proximate said second end of said ramp.

11. The assembly of claim 10 further including a flexible connective member for interconnecting said ramp to the dock structure and controlling pivotal lowering of said ramp relative to the dock structure and the boat.

12. The assembly of claim 8 in which said cable has a first end portion attachable to said lift platform and an opposite, second end portion attached to said ramp proximate said second end of said ramp.

13. The assembly of claim 8 in which said cable attaches to said ramp at a location along said ramp that is closer to said second end than said first end of said ramp.

14. The assembly of claim 8 further including a pivot shaft for mounting on the dock structure and at least one cylindrical bushing carried by said first end of said ramp for pivotally engaging said pivot shaft and allowing said ramp to pivot upwardly and downwardly relative to said dock structure.

* * * * *